United States Patent [19]

Osterlund et al.

[11] Patent Number: 4,729,680

[45] Date of Patent: Mar. 8, 1988

[54] SELECTOR LATCH FOR A SHEET FEEDER

[75] Inventors: Alfred G. Osterlund, Los Gatos; James G. Hume, Mountain View, both of Calif.; John R. Leicht, Bedford; Charles L. Bradford, Garland, both of Tex.

[73] Assignee: Xerox Corporation, Stamford, Conn.

[21] Appl. No.: 871,936

[22] Filed: Jun. 9, 1986

[51] Int. Cl.[4] ..... B41J 11/58; B41J 13/10

[52] U.S. Cl. ..... 400/624; 400/629; 400/649; 271/9; 192/20; 192/93 R

[58] Field of Search ..... 400/605, 624, 625, 629, 400/649, 185, 187; 192/20, 71, 93 R; 271/9

[56] References Cited

U.S. PATENT DOCUMENTS 4,248,415 2/1981 Steinhilber ..... 400/624
4,564,187 1/1986 Costa et al. ..... 400/624
4,570,919 2/1986 Huang ..... 400/624
4,620,809 11/1986 Runzi ..... 400/624

FOREIGN PATENT DOCUMENTS 42079 3/1985 Japan ..... 400/624

*Primary Examiner*—David Wiecking
*Attorney, Agent, or Firm*—Serge Abend

[57] ABSTRACT

A sheet feed device for sequentially selecting and feeding sheets of paper from one or more trays or magazines mounted upon a printer and delivering them to the platen of the printer. The device includes one or more selector latch mechanisms, one associated with each tray, whose movement is controlled by the platen rotation and which, in turn, controls the rotation of sheet feed rollers associated with the trays, in response to a specific sequence of forward and reverse angular platen movements.

5 Claims, 12 Drawing Figures

SELECTOR LATCH FOR A SHEET FEEDER

FIELD OF THE INVENTION

This invention relates to a sheet feeder for use in printers, in which sheets of paper are stored in one or more trays or magazines selectively mountable upon the printer and in which individual sheets are selected and sequentially fed from one of the trays to the platen of the printer. More particularly, the sheet feeder includes one or more selector latch mechanisms, one associated with each tray, whose movement is controlled by the platen rotation and which, in turn, controls the rotation of sheet feed rollers associated with the trays, in response to a specific sequence of forward and reverse angular platen movements.

BACKGROUND OF THE INVENTION

It is often desirable to be able to automatically feed sheets directly to the platen of a printer without the intervention of an operator. To that end, sheet feeding attachments, incorporating one or more trays, or magazines, are conventionally available for being mounted upon most office printers. Frequently, it is not sufficient to provide a sheet feeder having but a single tray because it may be desirable to be able to print upon sheets having different characteristics, for example, letterhead, colors, legal size, forms, etc. Thus, paper having different characteristics would be stored in different trays and the appropriate sheet feeder would be energized upon receiving the correct signal.

Automatic sheet feeding from a sheet feeder accessory assembly mounted upon the printer commonly has been accomplished by providing a separate drive motor for the accessory assembly and a transmission for selectively driving feeder rollers associated with each tray, or even providing a drive motor for each tray of the sheet feeder. The printer drive logic would be deisgned to signal and control the transmission or the appropriate drive motor for feeding sheets from the selected tray, in the proper sequence, and at the proper time. However, the cost of separate drive motors is costly. In order to reduce the cost of the sheet feeder accessory assembly it is desirable to minimize the number of components. By totally eliminating all motors in the assembly and by using the driving force of the printer platen to drive the sheet feeding assembly, an extremely inexpensive device can be fabricated, wherein sheet selection and feeding would be accomplished by the printer itself. When the platen drive motor is programmed to rotate and counter-rotate in a sequence of steps, it is possible to cause a selector latch mechanism, associated with the desired sheet feeder tray, to couple the platen drive to the sheet feeder rollers, so as to first select the proper tray and then to initiate feed therefrom. The sequence should be complicated enought so that there is a very low probability that ordinary advancing and reversing movements of the platen (such as encountered when filling in forms or making corrections on prior lines of print) will trigger the feeding of sheets.

In U.S. Pat. No. 4,248,415 (Steinhilber) entitled "Apparatus for Feeding Sheets of Paper From a Magazine to a Printing Office Machine" and in U.S. Pat. No. 4,475,731 (Wood) entitled "Programmable, Mechanical System for Feeding Cut Sheet Paper to a Printer" there is disclosed such a purely mechanical sheet feed arrangement. Power is only transmitted to sheet feed rollers in response to a preselected sequence of rotations and counter-rotations of the printer platen which cause a selector mechanism to latch the drive train to the feeder rollers. If the proper sequence of rotations and counter-rotations is not applied to the selector mechanism, no power will be transmitted to a feed roller. Although each of these disclosed selector mechanisms has the advantage of being purely mechanical, each has the disadvantage that its incorporated selector mechanism is comprised of numerous precision parts causing it to be relatively complex and expensive to manufacture.

It is therefore the principal object of the present invention to provide a simplified selector latch mechanism having a minimal number of parts and incorporating integral, highly accurate control surfaces. This enables the mechanism to be less expensive to manufacture and assemble, while enabling it to be more reliable in operation.

The improved sheet feeding mechanism of this invention may be carried out, in one form, by providing a selector latch mechanism for the sheet feeder attachment to a printer including a motor driven platen. The mechanism receives motive power from the platen and delivers motive power to a sheet stripper roller on the attachment. It comprises a rotatable drive gear for receiving motive power from the platen. A drive pin is carried by the drive gear and is movable therewith in a generally circular motion, and also is movable in a generally radial direction relative to the drive gear, about a pivot point on the drive gear. The pin is biased in the radial inward direction. A toothed driven gear is in driving engagement with the sheet stripper roller and is located for receiving the drive pin between its teeth when the drive pin is at its furthest radially inward position. A selector disc is mounted in face-to-face coaxial relationship with the drive gear and includes cam formations and gates integrally formed thereon, wherein the cam formations control the radial movement of the pin and the gates provide an escapement path for the pin. Starting with the drive pin at its home position, the proper sequence of forward and reverse drive gear angular movements allows the drive pin to follow a labyrinthine path to the sheet feed driving position where the drive pin engages the toothed driven gear.

These and other features of the present invention may be better understood by references to the following specification, taken in conjunction with the accompanying drawings, in which:

DETAILED DESCRIPTION OF THE ILLUSTRATED EMBODIMENT

Figure 1:
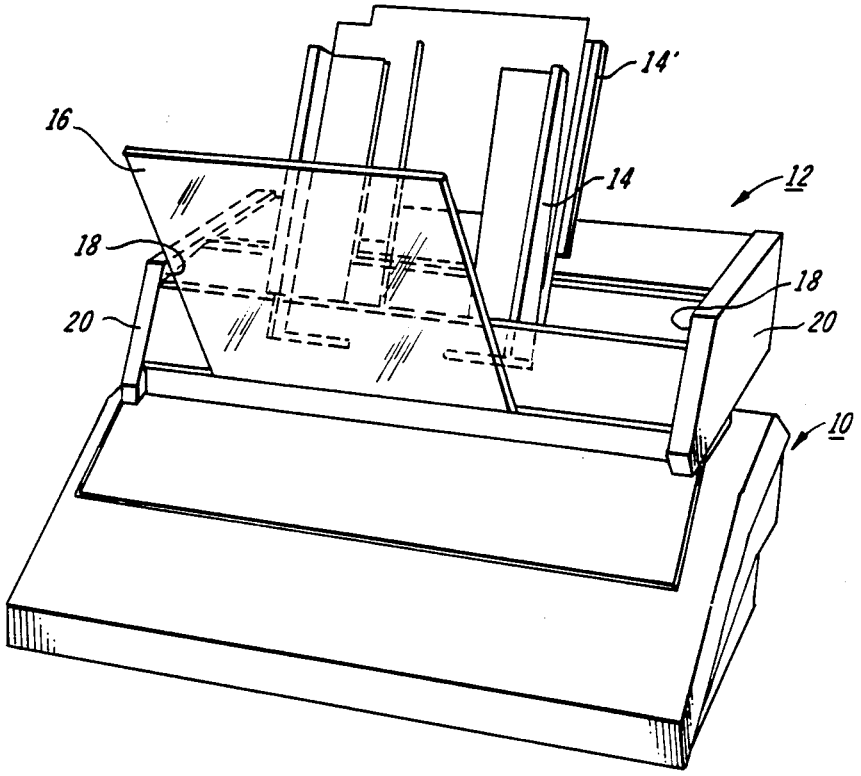
FIG. 1 is an isometric view of a printer having a sheet feeder accessory incorporating this invention mounted thereon.

With particular reference to the drawings there is illustrated in FIG. 1 a printer 10 upon which is mounted a sheet feeder accessory assembly 12. The sheet feeder, as illustrated, shows a pair of sheet storage trays 14 and 14' and an output tray 16. Of course, it is understood that the feeder may be made with but a single storage tray or may be made with more than two trays depending upon the needs of the user. The appropriate feeder will be selected and used in accordance with operational requirements. Side walls 18 and appropriate side covers 20 enclose the drive train and sheet feeding mechanism best shown in FIGS. 2 and 3.

Figure 2:
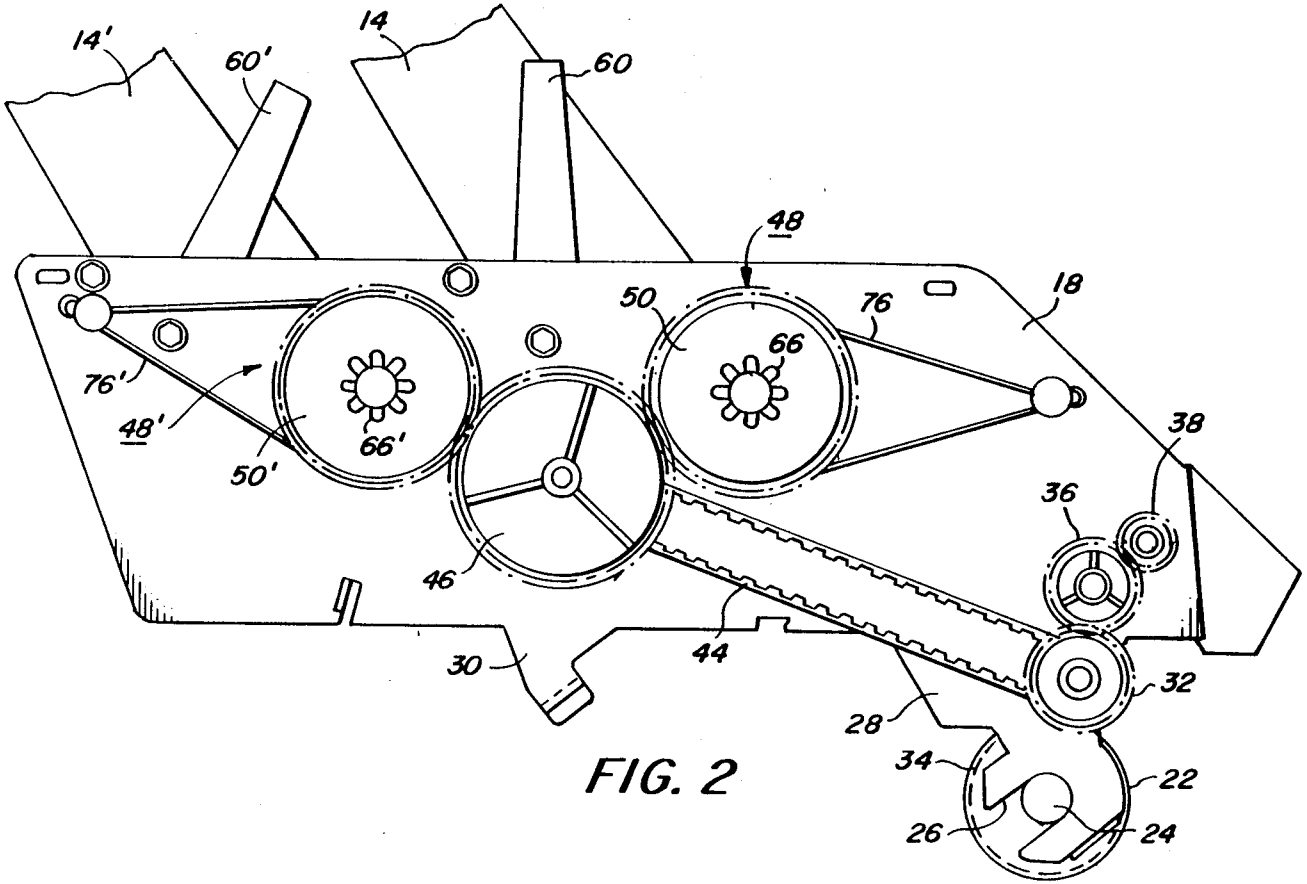
FIG. 2 is a left side elevation view of the sheet feeder accessory and the printer platen of FIG. 1, showing the sheet feeding mechanism drive train.

Although the printer is not shown in FIG. 2, its relationship to the sheet feeder may be understood with reference to the printer platen 22 and its support shaft 24. Each end of the shaft 24 supports a U-shaped seat 26 formed in each of the sheet feeder support arms 28 extending from each side wall 18. Latching arms 30 also depend from each side wall, to secure the feeder assembly to the printer. When properly in place, the power gear 32 of the feeder drive train is mated with a platen gear 34 (shown in phantom lines). A sheet output gear train, comprising gears 36 and 38, is in engagement with platen gear 34 for driving output roller 40 and idler roller 42 (see FIG. 3). Drive belt 44 connects the platen gear 32 to a common transmission gear 46 which drives selector mechanisms 48 and 48' through selector drive gears 50 and 50' for feeding a sheet of paper from a selected one of the storage trays 14 or 14' at the proper time and for delivering it to the printer platen 22. The sequence of feeding steps will become apparent as the selector mechanism structure and its operation is more fully described below.

Figure 3:
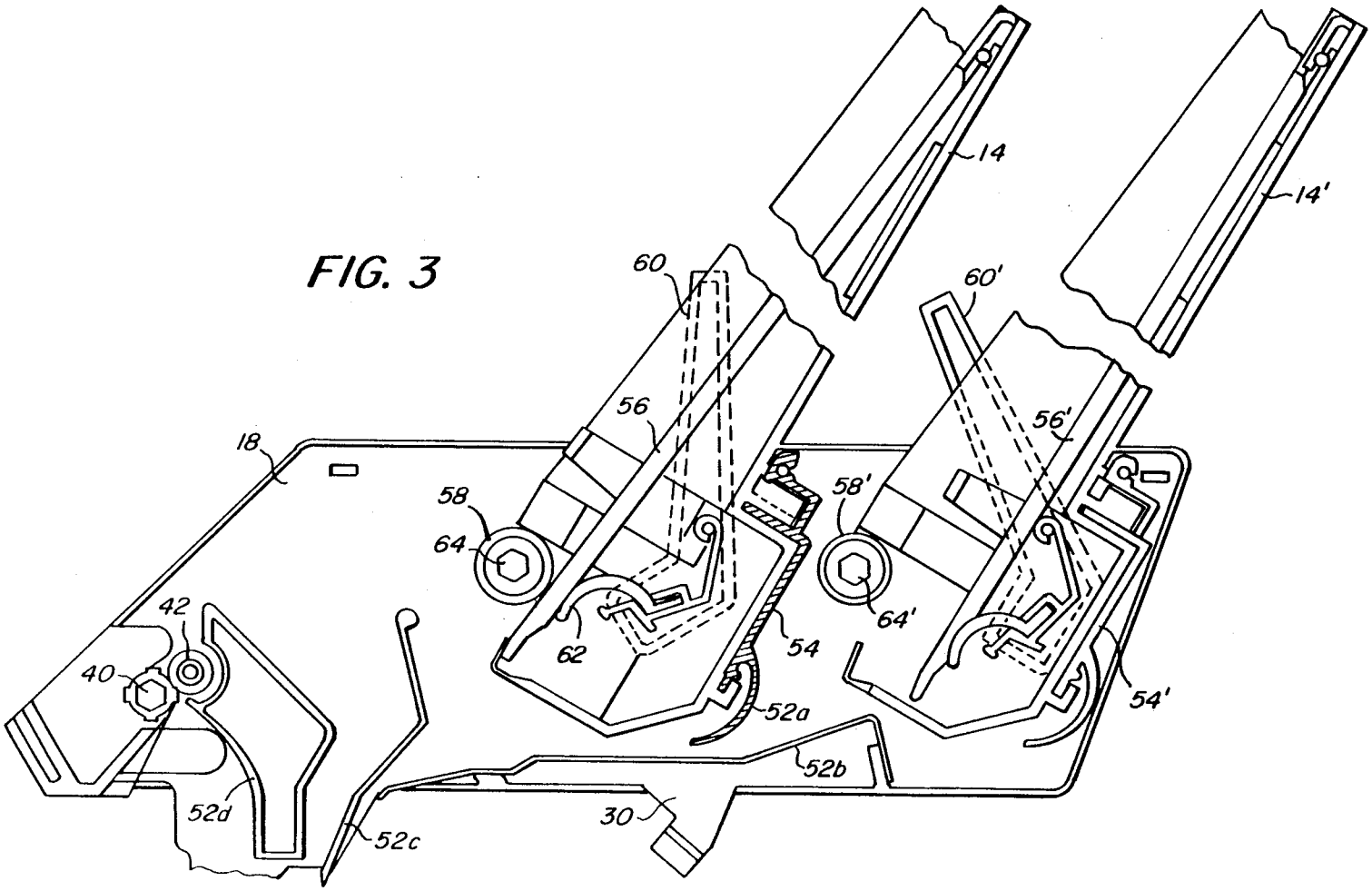
FIG. 3 is a right side elevation view of the sheet feeder accessory showing the sheet storage trays and the sheet feeder rollers.

In FIG. 3, the storage trays (14 and 14') and sheet directing baffles (52*a*, 52*b*, 52*c*, 52*d*) are clearly shown. Each tray 14 and 14' is mounted in a support bracket 54 and 54' mounted between side walls 18. Each support bracket is formed to serve the dual purpose of retaining a storage tray and guiding (52*a*) the sheet passing from the next adjacent upstream storage tray. A movable stack supporting plate 56 may be biased toward sheet stripping rollers 58 (in tray 14) by means of a lever arm 60 which urges pushing arm 62 thereagainst. Alternatively, when the lever 60' is in the position shown relative to tray 14', the pushing arm 62' allows the supporting plate 56' to be remote from sheet stripping rollers 58', for loading the tray.

Figure 4:
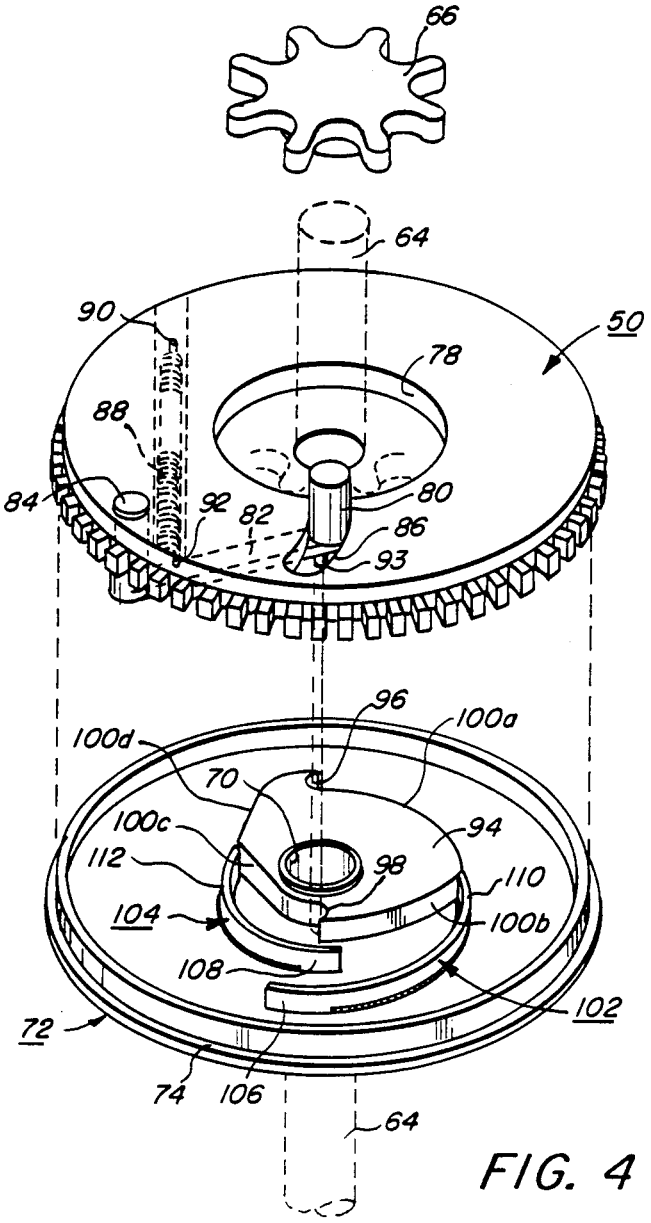
FIG. 4 is an exploded isometric view of the sheet feeder selector mechanism.
Figure 5:
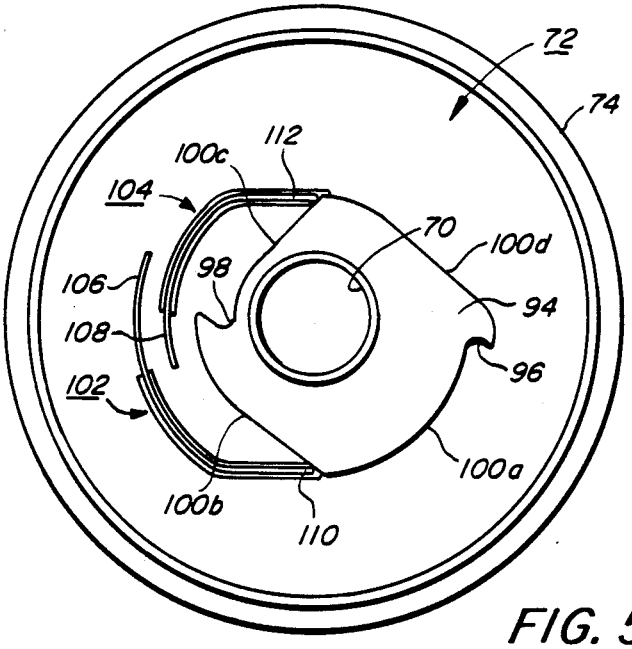
FIG. 5 is a plan view of the camming selector disc of the sheet feeder selector mechanism.
Figure 6:
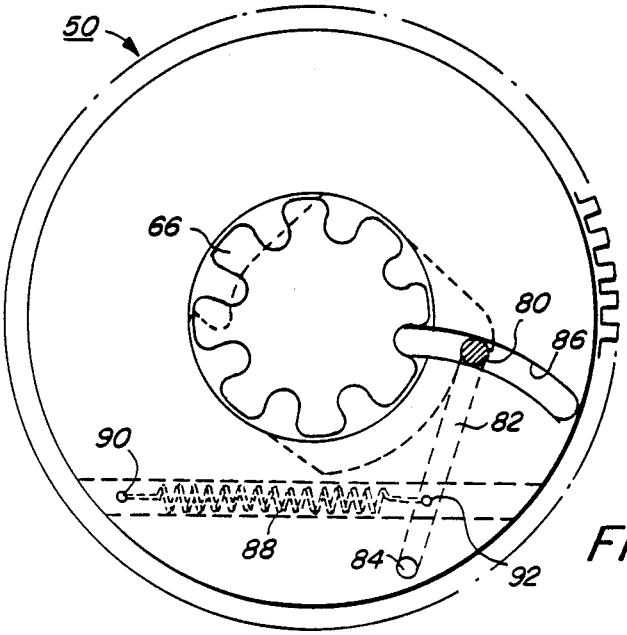
FIG. 6 is a plan view of the driving elements of the sheet feeder selector mechanism.
Figure 7:
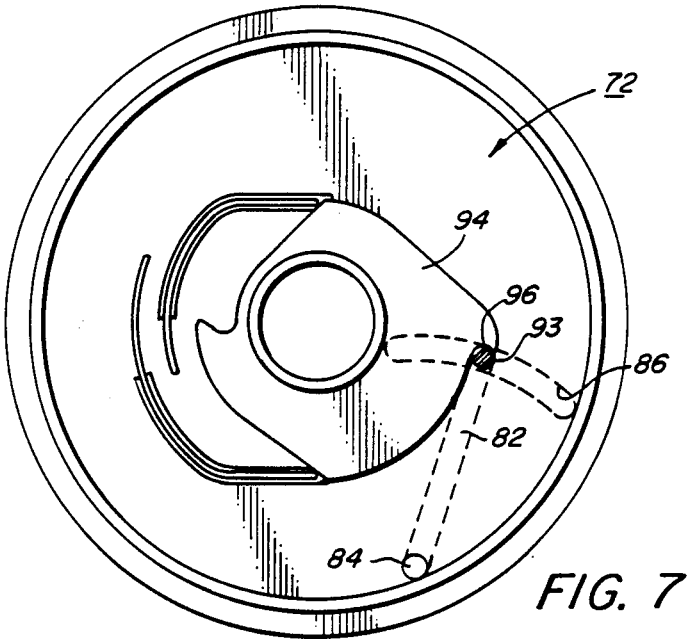
FIGS. 7–10 illustrate the progression of the drive pin from its home position, over the cam formations, and terminating at its driving position.
Figure 8:
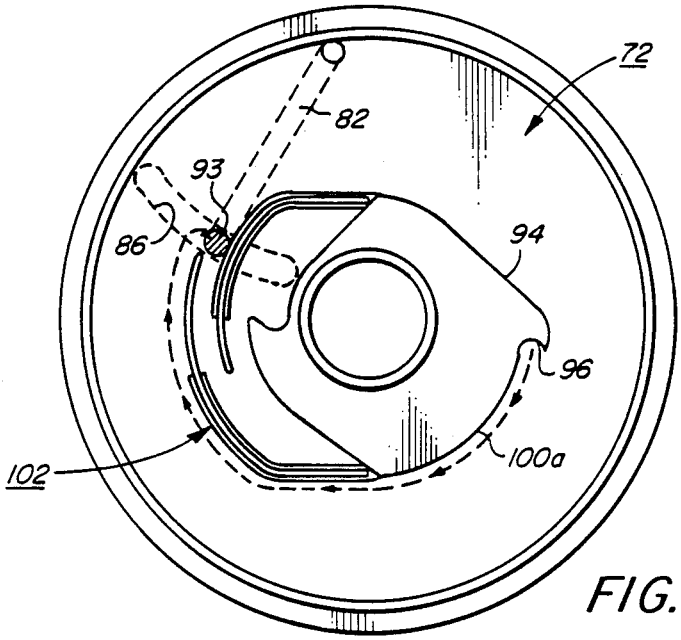
Figure 9:
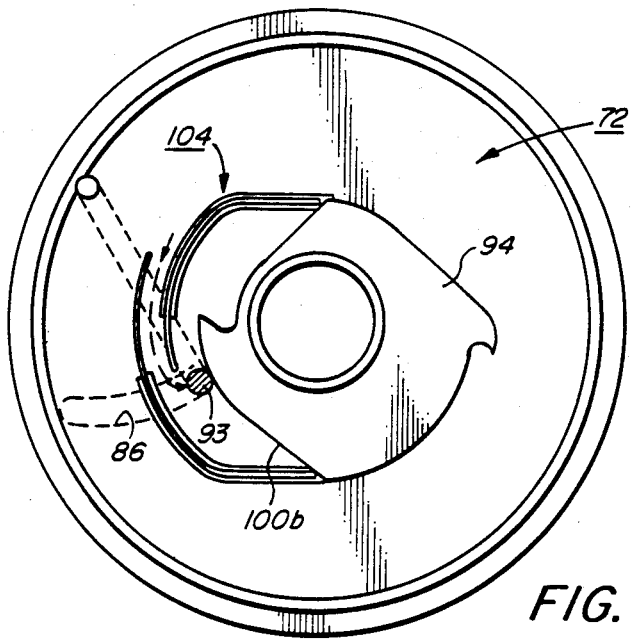

The sheet stripping roller 58 is mounted upon shaft 64 which extends through the left side wall (as viewed in FIG. 1) and supports driven gear 66 which is controlled by the selector mechanism 48, now described with particular reference to FIGS. 4, 5 and 6. The unique selector mechanism comprises selector drive gear 50 having a central cylindrical hub (not shown) extending axially into a central cylindrical opening 70 in selector disc 72. This allows the drive gear 50 to rotate freely upon and coaxially with respect to the selector disc. A flange 74 on the selector disc receives two arms of a retaining spring 76 (see FIG. 2) which urges the disc 72 against the side wall 18 in order to retard its free rotation. The driven gear 66 is located in a cylindrical seat 78 in drive gear 50. A drive pin 80 extends from one end of a pivotable arm 82. A pivot pin 84 extends from the opposite end of arm 82 and is seated in an opening in drive gear 50 for constraining the arm to move in an arcuate path. The pin 80 is constrained for movement in an arcuate slot 86 extending through the drive gear, the slot having its radially innermost extent disposed at about the root of the toothed region of driven gear 66. A light gauge tension spring 88 has one end 90 affixed to the drive gear 50 and its opposite end 92 fixed to the pivotable arm 82 for urging the drive pin radially inwardly. As the drive gear 50 is rotated by transmission gear 46, the drive pin 80 also moves in a generally circular path around the axis of the selector mechanism and is urged radially inwardly by the tension spring 88. An extension 93 of the drive pin moves in contact with cam and gate formations on selector disc 72 for altering the radial position of the drive pin.

The motion altering selector disc comprises a major cam formation 94 including a home stop 96 and a driving stop 98 (both stops are in the form of a parrot's beak) separated by cam runs 100*a*, 100*b*, 100*c* and 100*d*. In addition, cam/gates 102 and 104, comprising web-like formations extending upwardly from the planar floor of selector disc 72, are only connected to the disc at root portions 106 and 108 and are unconnected to the disc for the remainder of their length so that the gate portions 110 and 112 formed thereby are unconstrained and are free to pivot about the roots 106 and 108. The gate portions are only free to move radially outwardly since the extent of their radial inward movement in limited by interference with the major cam formation 94. Thus, movement of the drive pin extension 93 in a counterclockwise direction along cam run 100*b* will allow the pin to deflect the gate portion 110 and pass to cam run 100*a*. Likewise, movement of the drive pin extension 93 in a clockwise direction along cam run 100*c* will allow the pin to deflect the gate portion 112 and pass to cam run 100*d*.

Operation of the selector latch mechanism 48 will now be described with particular reference to FIGS. 7 to 11. Sheet selection is under programmed printer control because the motive force for the selector latch mechanism and sheet feed rollers is derived from rotation of the platen 22. The following description of the operation references forward and reverse platen rotation. Forward rotation refers to the platen rotating in the sheet advancing direction (counterclockwise as viewed in FIG. 2), and reverse rotation refers to the platen rotating in the sheet retracting direction. By following the gear train in FIG. 2, it can be seen that forward platen rotation results in the selector drive gears 50, 50' moving the sheet feeding direction (also counterclockwise).

Figure 10:
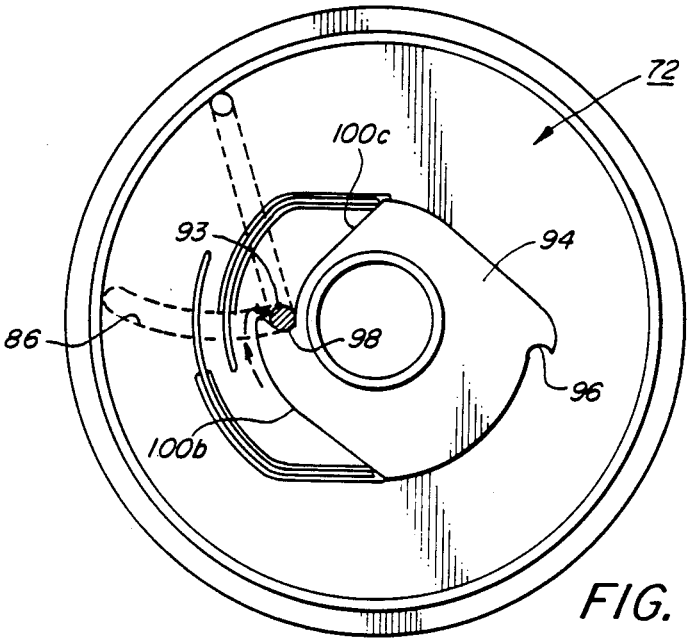
Figure 11:
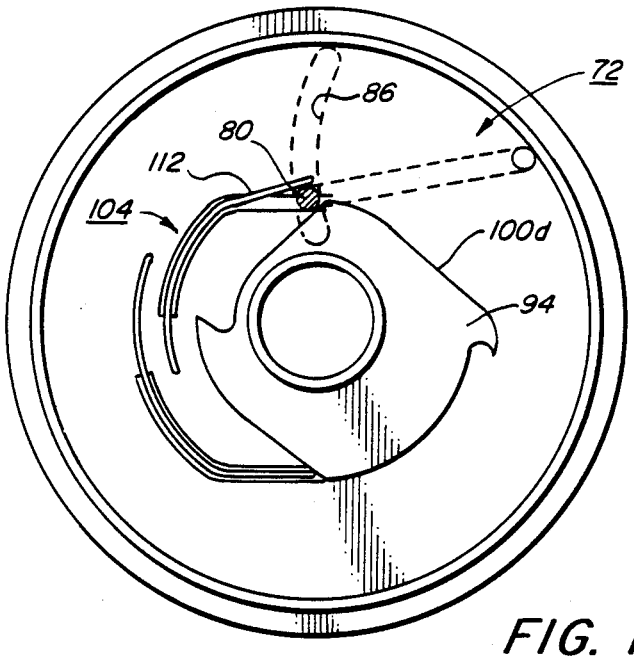
FIG. 11 illustrates the drive escapements made possible by the cam/gate formations.
Figure 12:
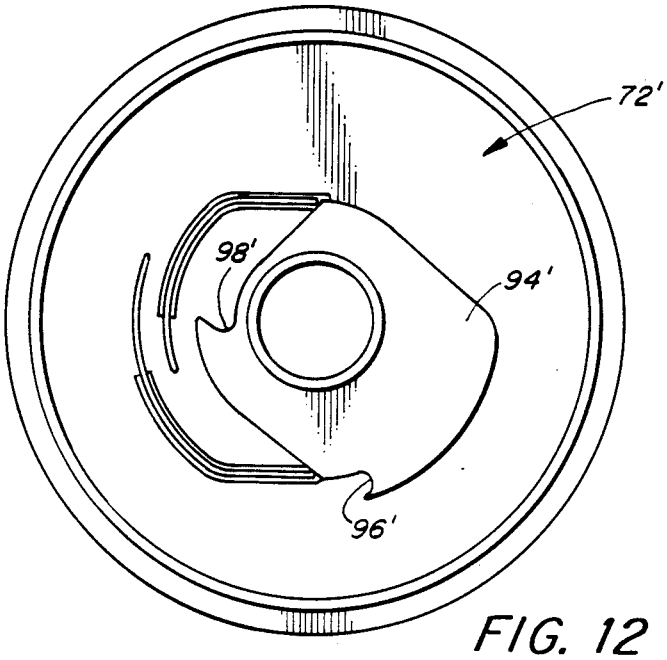
FIG. 12 is a top plan view of another camming selector disc for use on a different tray.

Starting with the drive pin extension 93 at the home stop 96 (FIG. 7), where it is normally seated during substantially the entire sheet advancing sequence, the sheet selecting, feeding, inserting and escaping procedure takes place as follows:

a. To select the topmost sheet from tray 14 and initiate feeding therefrom, the printer program causes the platen motor to rotate the platen 22, first ten lines reverse (FIG. 8), then four lines forward (FIG. 9) and then four lines reverse (FIG. 10). This combination of angular movements causes the drive pin extension 93 to be urged to the driving stop position 98, allowing the drive pin 80 to enter between the teeth of driven gear 66.

a'. The combination of angular movements to select the topmost sheet from tray 14' and initiate feeding therefrom is first seven lines reverse, then four lines forward, and finally four lines reverse. It can be readily seen that since the only difference between the selector discs 72 and 72' is the location of the home stops 96 and 96', the combination of angular movements differs only in the first angular movement which displaces the drive pin extension from the home stop. The remainder of the operational description will only reference feeding from tray 14. It should be understood that the same sequences will apply to feeding from tray 14'.

b. Continued forward rotation of the platen will cause the selector drive gear 50 to move the driven gear 66 and the stripper roller shaft 64. The sheet stripping rollers 58 will then advance the lead edge of the topmost sheet to the platen nip. It will take twenty-five lines of forward platen rotation to advance the sheet to the region of the nip. Since the tray 14' is further from the nip, the platen motor will advance by forty-five lines.

c. Registration is then confirmed by creeping the platen forward in minute line increments, e.g. 1/48 inch, until suitable sensor switches (not shown) indicate the arrival of the lead edge. The lead edge is driven into the nip as the platen is rotated in the sheet advance direction, thus insuring a positive placement of the sheet on the platen. However, if after a predetermined amount of creeping advancement the sensor switches do not indicate arrival of the lead edge, an error condition is acknowledged and the operator is so informed.

d. Once the sheet is captured by the platen, it is forwarded another eight lines in order that an escapement sequence may be effected to remove the drive pin 80 from the driving position and prevent the unwanted feeding of another sheet. Then seven lines of reverse platen rotation (FIG. 11) will move the drive pin extending 93 along cam run **100*c* and through gate 112 of cam/gate formation 104. Since the sheet is captured between the platen nip and the sheet feed rollers, this movement will result in a buckling of the sheet between the nip and the stationary sheet feed roller 58. Provision is made between sheet directing baffles 52*b* and 52*c*** to receive the buckle in the sheet feed path.

Now the sheet is properly positioned to receive the frist print line and the printer is able to enter the printing mode wherein the platen is advanced from line-to-line. This will once again move the drive pin extension 93 in a counterclockwise direction, over the cam and gate formations on frictionally held selector disc 72. The drive pin extension will first move over cam/gate 104, then drop down onto cam run **100*b*, pass through gate 110 of cam/gate formation 102, and over cam run 100*a* to the home stop 96. As the drive pin extension follows the cam formations in the escapement sequence, the drive pin moves radially outwardly and will disengage from the driven gear 66. Therefore, continued forward platen rotation will not effect further sheet feed. Since the drive pin extension is captured at the home stop, continued sheet advance will then cause the drive pin extension to overcome the frictional forces holding selector disc 72** stationary and will rotate the entire selector mechanism in a counterclockwise direction.

During printing it is quite conceivable that the platen will be reversed, as for example, when the operator must correct an error on a previous line, or fill in a form. In such cases the platen would be moved in a sequence of reverse angular movements following forward movements, but it is highly unlikely that the specific sheet feeding sequence described above would be casually encountered. The sheet feed sequence has been designed to be complicated enough that normally encountered platen motions would not coincide to select a tray and feed a sheet.

It can now be seen that the selector latch mechanism of this invention is simple and elegant. It incorporates in a single cam element all that is necessary for insuring that a proper sequence of events can select and feed a sheet of paper while simultaneously diminishing the likelihood of inadvertent selection and feed. By integrally molding these precise cam and gate elements, there can be no assembly error or tolerance buildup and operation will be correct every time.

Although the above described operation set forth a specific number of steps in a series for causing sheet feeding, it should be understood that the present disclosure has been made only by way of example and that other combinations of angular rotation and counterrotation and other details of construction and the arrangement of parts may be resorted to without departing from the true spirit and the scope of the invention as hereinafter claimed.

What is claimed:

1. A selector latch mechanism for a sheet feeder attachment to a printer, said printer including a motor driven platen, said mechanism receiving motive power from said platen and delivering motive power to a sheet stripper roller on said attachment, said mechanism comprising:

a rotatable drive gear for receiving motive power from said platen;

a drive pin carried by said drive gear and movable therewith in a generally circular motion, said drive pin being also movable in a generally radial direction relative to said drive gear about a pivot point on said drive gear;

biasing means carried by said drive gear for urging said drive pin radially inwardly;

a toothed driven gear connected to said sheet stripper roller for driving said roller, said driven gear being located for receiving said drive pin between its teeth when said drive pin is at its furthest radially inward position; and a selector disc having cam means and gate means integrally formed thereon for controlling the radial movement of said pin, said cam means comprising a major formation fixed to said selector disc so as to be immovable with respect thereto, said major formation having surfaces over which said pin moves, and said cam means further includes a pair of flexible web-like formations having radially outermost surfaces over which said pin moves, each of said web-like formations having one end fixed to said selector disc so as to be immovable with respect thereto, and an opposite unconstrained end biased toward said major formation, said unconstrained ends forming said gate means which provides an escapement path for said pin.

2. The selector latch mechanism as recited in claim 1 characterized in that said major formation includes a driving stop located at the furthest radially inward position of said drive pin located to retain said drive pin at said furthest radially inward position for driving said driven gear when said drive gear is driven in the sheet advancing direction during sheet feeding.

3. The selector latch mechanism as recited in claim 1 characterized in that said major formation includes a home stop located to retain said drive pin remote from said toothed driven gear when said drive gear is driven in the sheet advancing direction and no sheets are being fed.

4. The selector latch mechanism as recited in claim 1 characterized in that said drive gear defines an arcuate slot therethrough located to constrain said drive pin for movement in said generally radial direction.

5. The selector latch mechanism as recited in claim 1 characterized in that said selector disc is mounted in coaxial face-to-face relationship with said drive gear.

* * * * *